United States Patent [19]

Zünd

[11] Patent Number: 4,832,402

[45] Date of Patent: May 23, 1989

[54] ADJUSTING MECHANISM FOR A CHAIR

[75] Inventor: Karl Zünd, Rebstein, Switzerland

[73] Assignee: Karl Zünd & Co. AG, Rebstein, Switzerland

[21] Appl. No.: 154,087

[22] Filed: Feb. 9, 1988

[30] Foreign Application Priority Data

Feb. 10, 1987 [AT] Austria ..... 280/87

[51] Int. Cl.[4] ..... A47C 3/00

[52] U.S. Cl. ..... 297/302; 248/372.1; 248/565; 248/575; 297/304; 297/326

[58] Field of Search ..... 297/300, 301, 302, 304, 297/305, 312, 325, 326; 248/372.1, 562, 565, 566, 575, 596, 598

[56] References Cited

U.S. PATENT DOCUMENTS

| | | | |
|---|---|---|---|
| 2,859,799 | 11/1958 | Moore | 297/301 |
| 3,880,465 | 4/1975 | Scheber | 248/631 X |
| 4,521,053 | 6/1985 | de Boer | 297/312 |
| 4,629,249 | 12/1986 | Yamaguchi | 297/301 X |
| 4,707,029 | 11/1987 | Korn | 297/301 X |

FOREIGN PATENT DOCUMENTS

| | | | |
|---|---|---|---|
| 136796 | 4/1985 | European Pat. Off. | 297/355 |

*Primary Examiner*—Peter R. Brown

*Attorney, Agent, or Firm*—Toren, McGeady & Associates

[57] ABSTRACT

A chair, particularly a work chair, includes a mounting plate for fastening a seat and back member. The mounting plate is supported so as to be pivotable with its front end about a horizontally extending axis on a support member which is, in turn, supported by a vertically extending, essentially vertically adjustable support tube and projects laterally relative to the support tube. The mounting plate is supported on its side facing away from the pivoting axis and near the seat and back member by a gas pressure spring. The gas pressure spring has at one end thereof a valve tarppet for operating a valve which is integrated in the gas pressure spring, so that the effective length of the gas pressure spring is adjustable. The end of the gas pressure spring with the valve tappet is supported on the support member. A two-armed lever which acts on the valve tappet is pivotally mounted on a bearing block of the support member which bearing block supports the gas pressure spring. One arm of the two-armed lever is connected to a rod-like tension or compression member, the end of the latter being connected to an adjusting member which is pivotable about the pivoting axis of the mounting plate.

16 Claims, 4 Drawing Sheets

Fig.1
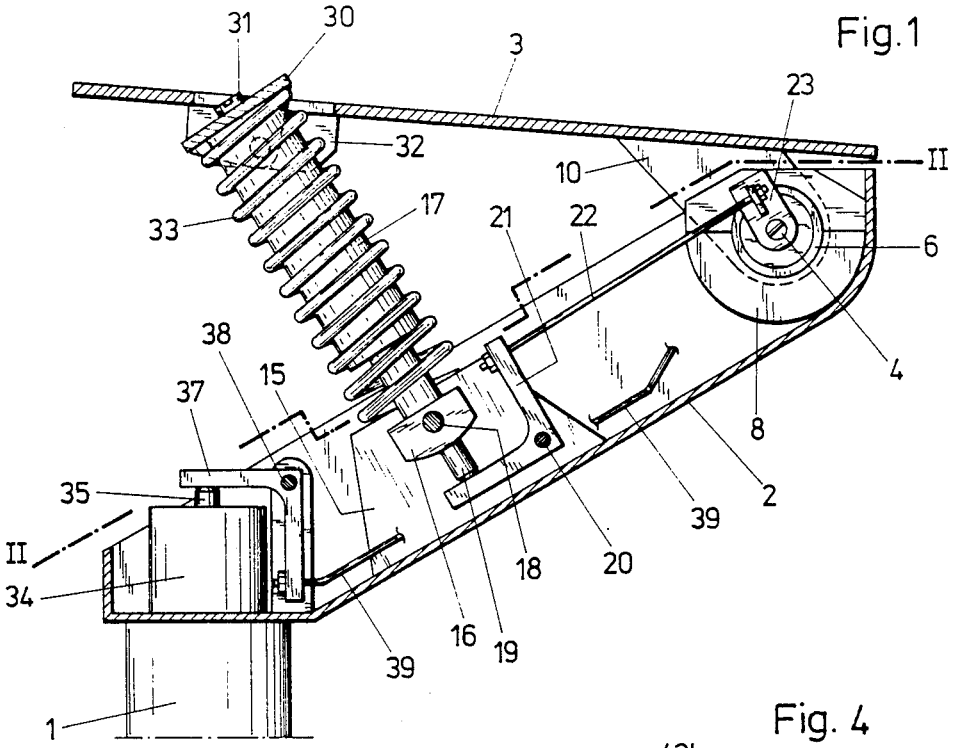
Fig. 4
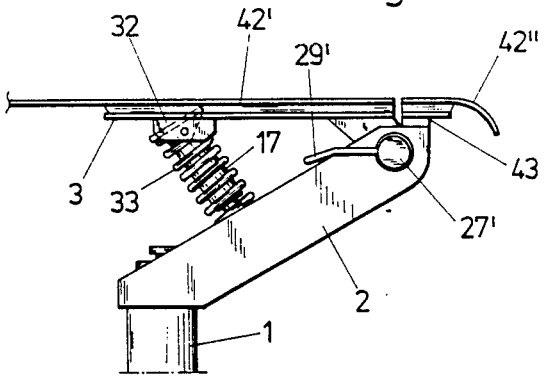
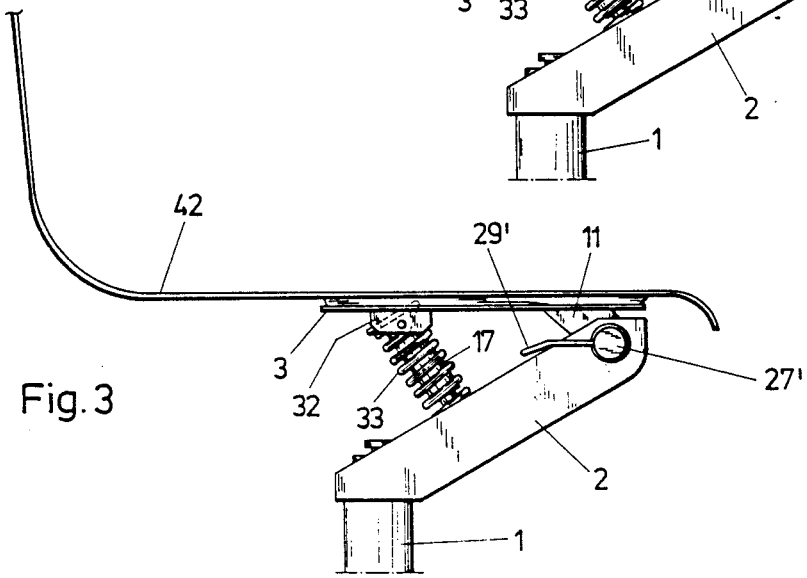
Fig. 3

31
30
3
23
32
10
33
17
44
45
22
6
46
4
38
15
8
37
47
35
48
21
20
39
18
34
2
16
19
39
1

12
15
10
36
35
37
21
20
44
8
22
24
23
40
41
39
46
45
34
9
2
19
14
5

ADJUSTING MECHANISM FOR A CHAIR

BACKGROUND OF THE INVENTION

1. Field of the Invention

The present invention relates to a chair, particularly a work chair, including a mounting plate for fastening a seat and back member. The mounting plate is supported so as to be pivotable with its front end about a horizontally extending axis on a support member which is, in turn, supported by a vertical, preferably vertically adjustable, support tube and projects laterally relative to the support tube. The mounting plate is supported on its side facing away from the pivoting axis and near the seat and back member by a gas pressure spring. The gas pressure spring has at one end thereof a valve tappet for operating a valve which is integrated in the gas pressure spring, so that the effective length of the gas pressure spring is adjustable.

2. Description of the Prior Art

Chairs of the above-described type are known. In such a work chair disclosed in German Pat. No. 20 00 172, a gas pressure spring is connected to the lower end of a vertical support member. The gas pressure spring extends essentially parallel to the vertical support member. The upper end of the gas pressure spring carrying the valve tappet supports through an intermediate support member the pivotally mounted mounting plate on which the seat and back member is fastened. An essentially horizontal threaded spindle extends through this intermediate support member. By actuating the spindle, the point where the gas pressure spring acts relative to the pivotable mounting plate is adjustable. This adjusting mechanism is not only structurally very complicated. The great structural height of the mechanism makes it very difficult to create an esthetically satisfactory solution. The same is true analogously for the seat constructions known from German Offenlegungsschrift No. 25 01 673 and German Utility Model No. 73 11 376.

In order to overcome particularly the disadvantage mentioned last and to provide an adjusting mechanism of low structural height, it has already been proposed to arrange the gas pressure spring horizontally and to transmit the forces to be applied by the gas pressure spring through a lever system to the mounting plate and the seat member. This adjusting mechanism does have a low structural height, so that the underside of the chair can be constructed in a way which is pleasing to the eye. However, the lever system required for this solution is very complicated and requires a large number of components, which must be considered a disadvantage.

Another work chair of the above-described type is disclosed in U.S. Pat. No. 2,859,799. In this chair, the mounting plate carrying the seat member is supported relative to a cantilevering support member by means of a helical spring. Again, a lever system is provided between the seat member and the support member. A threaded spindle which extends through the helical spring can be used to pretension the helical spring as desired, so that the initial position to be assumed by the seat member can be adjusted. Thus, the springiness of the seat member depends upon its respective initial position. In addition, the threaded spindle required for the adjustment, or the handwheel connected to the spindle, is not easily accessible for the user of the chair. A similar construction is illustrated and described in German Offenlegungsschrift No. 20 01 097, so that the chair described therein has the same disadvantages as those mentioned with respect to U.S. Pat. No. 2,859,799.

It is, therefore, the primary object of the present invention to provide a chair of the above-described type in which the adjusting mechanism has a low structural height, so that the underside of the seat member can be constructed in an esthetically satisfactory manner and that it is ensured that the hand levers provided for adjustment can be easily reached and operated by the user of the chair while the user of the chair maintains the normal sitting position.

SUMMARY OF THE INVENTION

In accordance with the present invention, in a chair of the above-described type, the end of the gas pressure spring with the valve tappet is supported on the support member which laterally projects from the support tube. A two-armed lever which acts on the valve tappet is pivotally mounted on a bearing block of the support member which bearing block supports the gas pressure spring. One arm of the two-armed lever is connected to a rod-like tension or compression member, the end of the latter being connected to an adjusting member which is pivotable about the pivoting axis of the mounting plate.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

BRIEF DESCRIPTION OF THE DRAWING

In the drawing:

FIG. 1 is a vertical cross-sectional view of the chair according to the present invention, taken along sectional line I—I in FIG. 2.

FIG. 3 is a side view, on a smaller scale, of the chair according to the present invention;

FIG. 4 is a side view of another embodiment of the chair according to the present invention;

DETAILED DESCRIPTION OF THE INVENTION

Figure 2:
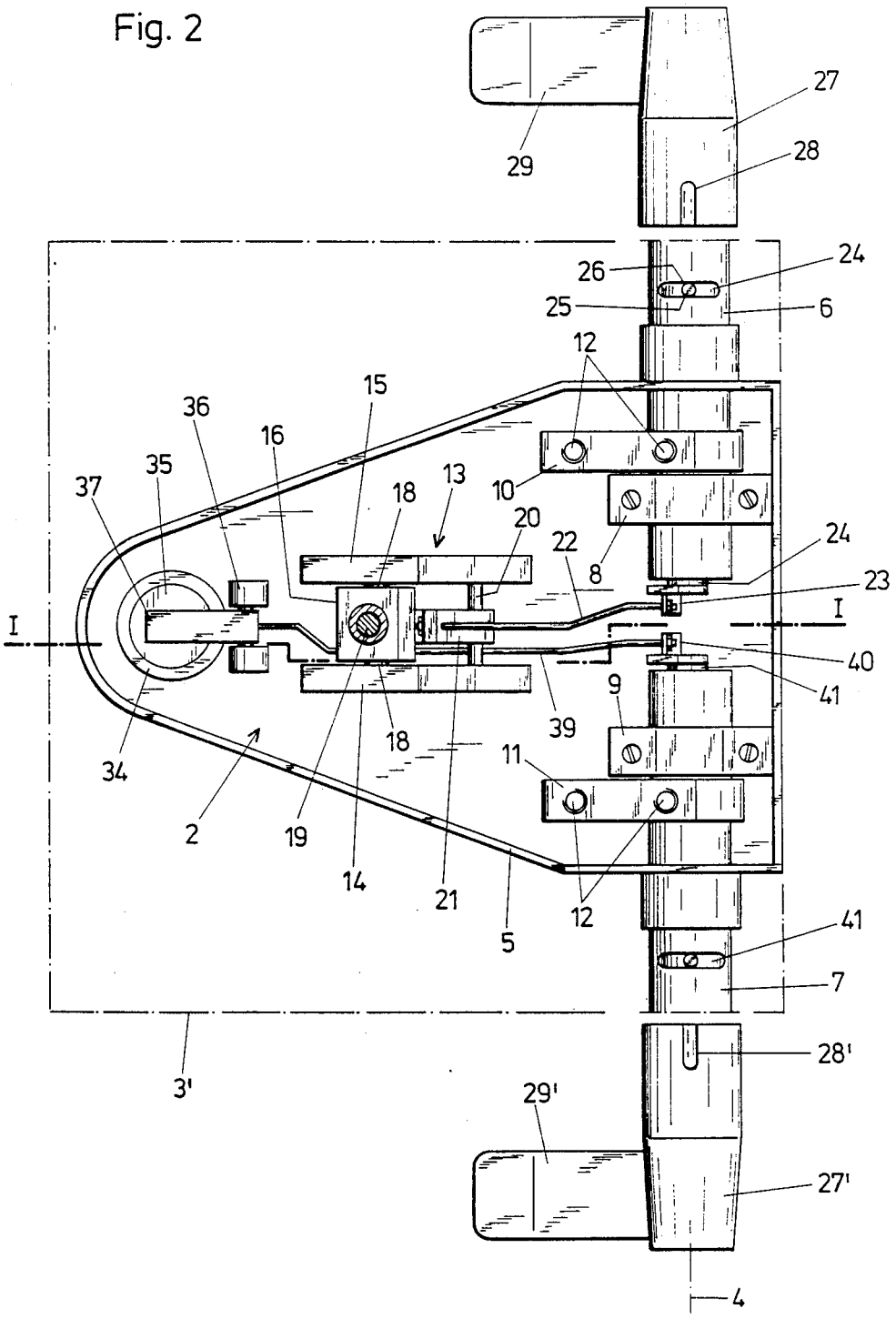
FIG. 2 is a top sectional view taken along sectional line II—II of FIG. 1.

As illustrated in FIG. 1 of the drawing, the chair according to the present invention includes a vertically extending support tube 1. The lower end of the support tube 1 is connected to a stand, not shown. To the upper end of the support tube 1 is connected a laterally projecting support member 2. Support member 2 extends upwardly and includes an acute angle with the horizontal. A seat and back member, not shown, is fastened on a mounting plate 3. The front end of the seat and back member is mounted so as to be pivotable about a horizontally extending axis 4 at the forward end of the support member 2.

As seen in the sectional top view of FIG. 2, support member 2 essentially has the shape of an equilateral triangle. Support member 2 has an upwardly bent rim 5 and, thus, has the shape of an upwardly open shell. This shell-shaped support member 2 has a narrowing portion with which it is attached to support tube 1. Two horizontally arranged and aligned pipe pieces 6 and 7 are provided on the freely cantilevering portion of support member 2. Pipe pieces 6 and 7 extend through rim 5 and the inner ends of the pipe pieces 6 and 7 are spaced apart from each other. The portions of the pipe pieces 6 and 7 which are located on the inside of rim 5 are rigidly connected to support member 2 by means of clamping members 8 and 9. Those portions of pipe pieces 6 and 7 which are located between the clamping members 8 and 9 and the respective rim 5 of support member 2 support bearing brackets 10 and 11 which are freely pivotable in a plane which extends perpendicularly of the drawing plane of FIG. 2. Threaded bores 12 are provided for receiving fastening screws which are used to fasten mounting plate 3 to bearing brackets 10 and 11.

In FIG. 2, the outline of mounting plate 3 is indicated by a dot and dash line 3'. Between the pipe pieces 6, 7, on the one hand, and the vertical support tube 1, on the other hand, a bearing block 13 rigidly connected to the support member 2 is provided which bearing block 13 is formed by two spaced-apart disk-like supports 14 and 15. The bearing block 13 supports the lower end of a gas pressure spring 17. The lower end of the gas pressure spring 17 is connected to a block 16 which is provided on two opposite sides with shaft journals 18 which are rotatably held in supports 14 and 15. The end of the gas pressure spring 17 received by block 16 further includes the valve tappet 19. The valve integrated in gas pressure spring 17 is actuated by an axial displacement of the valve tappet 19.

Another shaft 20 is provided between supports 14 and 15 of bearing blocks 13 on the side thereof facing the pipe pieces 6 and 7. A two-armed angular lever 21 is pivotally mounted on shaft 20. An arm of the angular lever 21 extending essentially parallel to support member 2 rests against valve tappet 19, while the upwardly extending arm of angular lever 21 is connected through a rod-like tension member 22 to an adjusting member 23.

Adjusting member 23 is rigidly connected to the end face of a shaft 24 which is rotatably mounted in pipe piece 6. The outer end of shaft 24 has a pin 25 which projects through a transversely extending oblong hole 26 in the outer portion of pipe piece 6 and which radially projects from pipe piece 6. A sleeve 27 with a longitudinally extending oblong hole 28 can be slid onto the outer portion of pipe piece 6. When sleeve 27 is slid on, oblong hole 28 positively engages the radially projecting pin 25. Sleeve 27 is additionally connected to a hand lever 29. Hand lever 29 extends toward support tube 1 and extends essentially parallel to the vertical plane of support member 2.

The upper end of gas pressure spring 17 has a U-shaped yoke 30 whose side portions are directed downwardly. Yoke 30 is secured to the upper end of the gas pressure spring 17 by means of a screw 31 which is screwed into the housing of gas pressure spring 17. The downwardly directed sides of U-shaped yoke 30 are pivotably connected to downwardly directed flanges 32 of mounting plate 3. The upper end of gas pressure spring 17 is connected to mounting plate 3 in or near the region where the vertical center axis of support tube 1 intersects mounting plate 3. In the embodiment illustrated in FIG. 1, gas pressure spring 17 is surrounded by a helical spring 33. Helical spring 33 rests with its lower end on supports 14 and 15 of bearing block 13. The upper end of helical spring 33 rests against the underside of the U-shaped yoke 30.

Another gas pressure spring 34 for the vertical adjustment of the seat of the chair is connected to and integrated in vertical support tube 1. The valve tappet 35 of this gas pressure spring 34 projects above the upper end of the gas pressure spring 34. A second angular lever 37 is pivotally mounted about axis 38 on another bearing block 36 which is rigidly connected to support member 2. The horizontally extending arm of lever 37 is in connection with valve tappet 35 and the arm directed downwardly from the pivoting axis 38 of angular lever 27 is connected with the tension member 39 to a second adjusting member 40 which is fastened to the end face of another shaft 41 mounted in the second pipe piece 7. This mounting is completely identical to the mounting described above in connection with pipe piece 6, shaft 24 and adjusting member 23. Also in this case, a sleeve 27' with a hand lever 29' and a longitudinally extending oblong hole 28' is provided, these members having the same purpose and construction as described above with respect to members 27, 28 and 29.

FIG. 2 shows that the inner ends of the two pipe pieces 6 and 7 are spaced apart from each other. The above-mentioned adjusting members 23 and 40 are located in the space between pipe pieces 6 and 7. The structure described above in detail is illustrated in FIG. 3 on a smaller scale. FIG. 3 further schematically shows a seat and back member 42 which is fixedly connected to mounting plate 3. Although this is not illustrated in the drawing, seat and back member 42 can be upholstered and covered.

The illustration of FIG. 4 differs from that of FIG. 3 in that the seat and back member of FIG. 4 is not constructed in one piece. In FIG. 4, a forward member 42'' is separate from the actual seat and back member 42' and is connected to support member 2 by means of a bracket 43 provided at the end face. The upholstering and covering of the seat and back member 42', 42'' is also not shown in FIG. 4. As FIGS. 3 and 4 do show, the hand levers 29, 29' are located underneath the forward portion of mounting plate 3, so that they are easily reached by the user of the chair, without the user of the chair having to move substantially from the normal sitting position.

If the inclination of the seat and back member 42 is to be changed during the use of the chair, the hand lever 29 is pulled up to some extent, so that shaft 24 and the adjusting member 23 connected to shaft 24 are pivoted in clockwise direction as seen in FIG. 1. As a result, the angular lever 21 is pivoted by the rod-like tension member 22 and angular lever 21, in turn, actuates valve tappet 19, so that seat and back member 42 can be pivoted upwardly or downwardly about axis 4 depending upon the load placed on seat and back member 42. When the hand lever 29 is released after the desired inclination of seat and back member 42 has been reached, the valve tappet 19 returns to its original position, the valve provided in gas pressure spring 17 is closed and, thus, the gas pressure spring 17 is blocked in its adjusted position. If the seat and back member 42 is to be vertically adjusted, this adjustment is achieved by actuating hand lever 29'. The movements of the structural components 35, 37, 39, 40 and 41 required for the vertical adjustment correspond to those required for the adjustment of the inclination.

Helical spring 33 reinforces the action of the parallel gas pressure spring 17. It is possible to make the upper portion of bearing block 13 removable by means of a lever system and an adjusting screw, so that the tension of helical spring 3 is adjustable.

Figure 5:
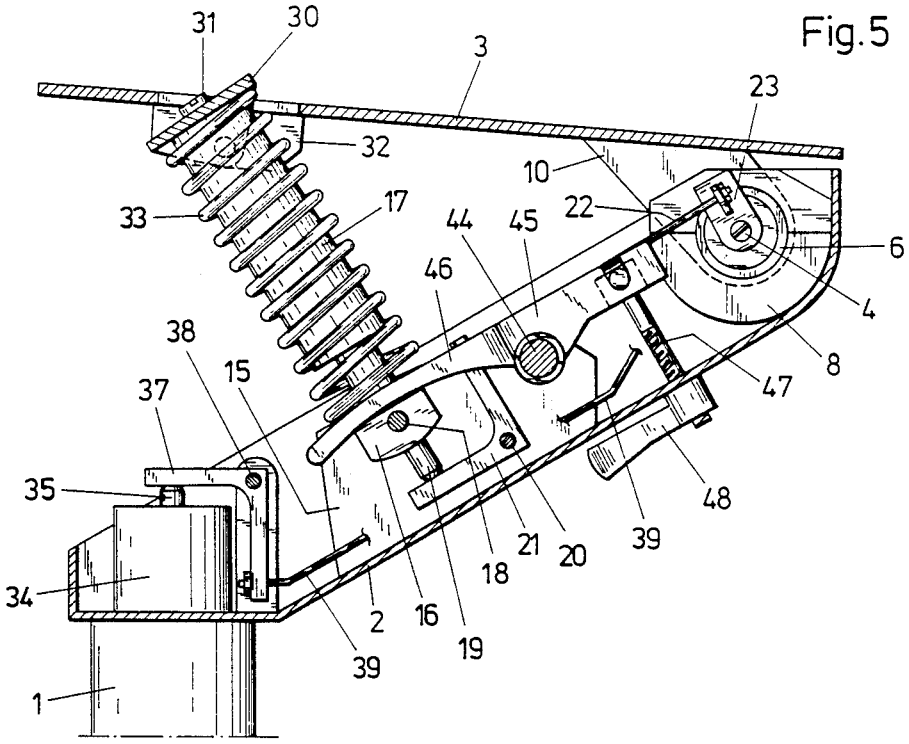
FIG. 5 is a vertical sectional view of another embodiment of the chair according to the present invention.
Figure 6:
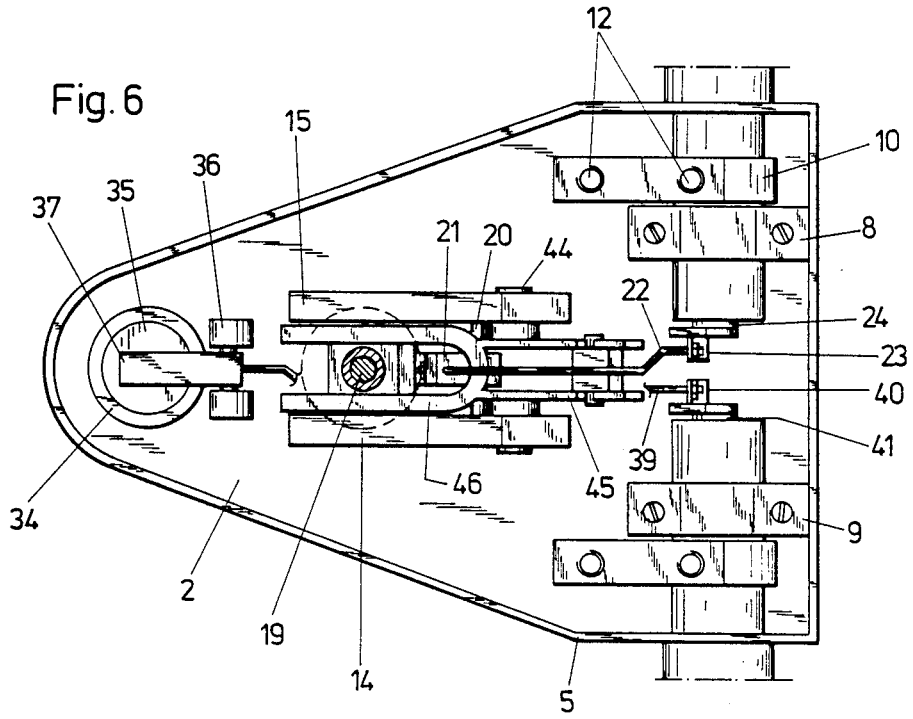
FIG. 6 is a top sectional view of the chair of FIG. 5.

A structural solution of this kind is illustrated in FIGS. 5 and 6. The illustrations of FIGS. 5 and 6 correspond to those of FIGS. 1 and 2 and the same structural components have the same reference numerals. For influencing the initial tension of spring 33, a two-armed lever 45 is provided whose pivoting axis 44 is located between shaft journal 18 of gas pressure spring 19 and axis 4 of pipe pieces 6 and 7 and extends parallel thereto. At its side facing the gas pressure spring 17, the lever arm has the shape of a fork 46, as can be seen in FIG. 6. The other lever arm is acted upon by a threaded spindle 47 which can be actuated by wing nut 48 or an appropriate handwheel in such a way that lever 45 is pivoted clockwise or counterclockwise as seen in FIG. 5. Since helical spring 33 rests with its lower end on the portion of the two-armed lever 45 constructed as a fork 46, spring 33 is more or less pretensioned as a result. The spring is indicated in FIG. 6 by a dot and dash line. FIG. 6 further shows that the spring rests on fork 46.

Figure 7:
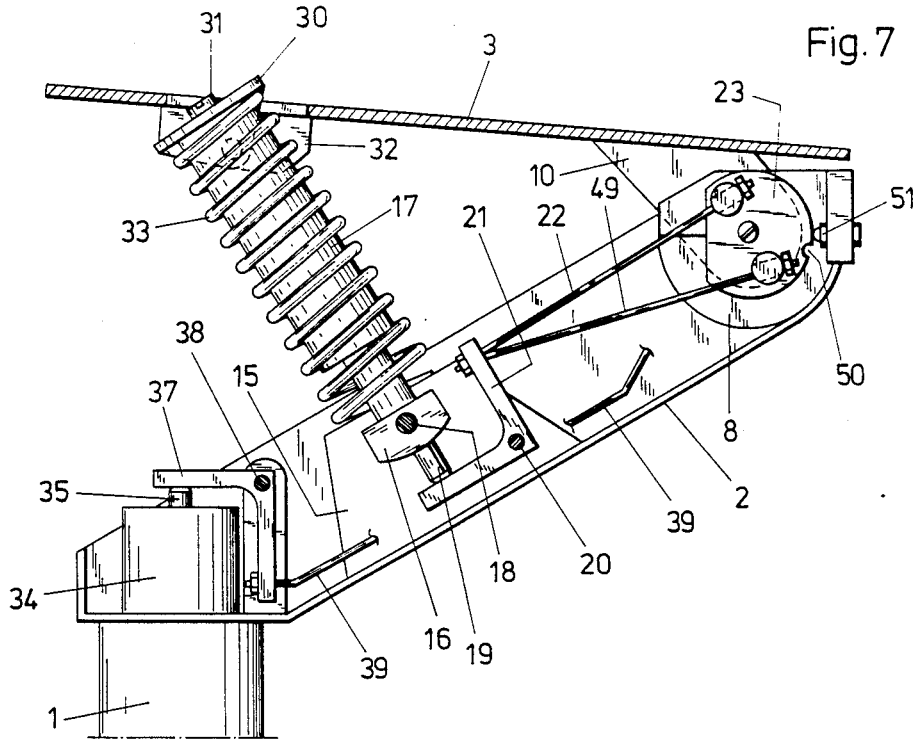
FIG. 7 is a vertical sectional view of another embodiment of the chair according to the present invention.

While it is required in the embodiments shown in FIGS. 1 and 2 or 5 and 6 for changing the inclination of the mounting plate 3 to grasp and pull up the hand lever 29 which, as soon as it is released, returns into its initial position, the hand lever 29 of the embodiment illustrated in FIG. 7 not only can be actuated in the above-described manner, but also is additionally automatically held in pivoted position, so that it is possible to rock the chair without having to grasp the hand lever 29.

The illustration of FIG. 7 corresponds to that of FIG. 1, wherein again the same structural components are provided with the same reference numerals. In the embodiment shown in FIG. 7, lever 21 is connected to two tension members 22 and 49 which are connected to the upright arm of lever 21 essentially at the same point. In this case, adjusting member 23 is constructed as a disk. The other end of tension member 49 is fastened to adjusting member 23 at a point which is diametrically opposite the point of connection of tension member 22 with adjusting member 23 in relation to axis 4. The edge of adjusting member 23 has a notch 50 which interacts with a ball-type locking member 51 attached to support member 2. When hand lever 29 is pulled upwardly, i.e., upwardly from the plane of the drawing of FIG. 2, adjusting member 23 is pivoted in clockwise direction as seen in FIG. 7 and the lever 21 is pivoted by tension member 22 with the consequences described above.

The end of tension member 49 is fastened to adjusting member 23 with play such that the turning or pivoting motion of adjusting member 23 does not exert any force on tension member 49. When hand lever 29 is released, it returns into its initial position under the influence of the force exerted by the gas pressure spring 17. If the valve of gas pressure spring 17 is to be opened and this opened state is to be maintained without having to hold hand lever 29, hand lever 29 is initially pressed downwardly, as seen in FIG. 2, until locking member 51 engages in notch 50. As a result, adjusting member 23 is pivoted counterclockwise as seen in FIG. 7 and results in the same pivoting action on lever 21 as caused in the previous case by tension member 22, with the only difference that when the hand lever is released, the latter is held in its position by the locking action of the locking member until the hand lever is again pulled upwardly by a manual operation. Thus, as long as the valve of the gas pressure spring is opened, the chair can be rocked by displacing the weight on the chair.

As illustrated in the embodiment of FIG. 3, the seat and back member 42 changes its inclination in its entirety when the hand lever 29 is operated as described above. In the embodiment of FIG. 4, member 42' remains in its predetermined position independently of the inclination of mounting plate 3.

In the illustrated embodiment, helical spring 33 surrounds gas pressure spring 17. The two springs are located coaxially relative to each other. It is also conceivable within the scope of this invention to arrange these springs next to each other. This is possible because of the space provided by the support member 2.

In addition, in the illustrated embodiment, support member 2 extends over its entire cantilevering length obliquely relative to support tube 1. It is also conceivable and within the scope of the invention to make the support member 2 angular over its cantilevering length, with a first horizontally extending portion connected directly to support tube 1 and a second upwardly inclined portion connected to the first portion.

In the embodiment described above, the angular levers 21 and 37 are actuated by rod-like tension members which have a bent shape over the length thereof. Such tension members are of simple construction. The use of such tension members results from the use of angular levers 21 and 37 and the type of mounting of valve tappets 19 and 35. It is basically also to use compression members instead of tension members, wherein the compression members act on pivotally mounted levers, however, the construction is not simpler as a result of the use of compression members.

While specific embodiments of the invention have been shown and described in detail to illustrate the application of the inventive principles, it will be understood that the invention may be embodied otherwise without departing from such principles.

I claim:

1. In a chair including a mounting plate having a front end and a seat and back member fastened on the mounting plate, the mounting plate being supported on a support member so as to be pivotable about a horizontally extending axis at the front end of the mounting plate, the support member being supported by a vertically extending, essentially vertically adjustable support tube and projecting laterally relative to the support tube, the mounting plate having a plate portion remote from the pivoting axis and near the back member, a gas pressure spring having first and second ends, the first end of the spring supporting the plate portion of the mounting plate, the gas pressure spring having at the second end thereof a valve tappet for operating a valve which is integrated in the gas pressure spring, so that the effective length of the gas pressure spring is adjustable, the improvement comprising the second end of the gas pressure spring with the valve tappet being supported on the support member, a two-armed lever which acts on the valve tappet being pivotally mounted on a bearing block of the support member, the bearing block supporting the gas pressure spring, a first arm of the two-armed lever being connected to a rod-like tension or compression member having first and second ends, the first end of the rod-like member being connected to an adjusting member which is pivotable about the pivoting axis of the mounting plate and the second end of the rod-like member being connected to the two-armed lever.

2. The chair according to claim 1, comprising a block member receiving the second end of the gas pressure spring having the valve tappet, shaft journals mounted on two opposite sides of the block member, the bearing block including two supports, the shaft journals being in alignment and being received in the supports of the bearing block, the supports being mounted adjacent the support tube, the shaft journals extending parallel to the pivoting axis of the mounting plate.

3. The chair according to claims 1 or 2, wherein the pivoting axis of the mounting plate is defined by two axially aligned pipe pieces which are fixedly connected to the support member, a shaft being rotatably mounted in a first of the pipe pieces, the shaft carrying the adjusting member connected to the tension or compression member, an outer end of the shaft being connected to a manually operated hand lever which extends essentially parallel to the support member.

4. The chair according to claim 3, wherein the mounting plate has an underside, two spaced-apart bearing brackets attached to the underside of the mounting plate at the front end thereof, the pipe pieces extending through the bearing brackets.

5. The chair according to claim 3, wherein a second shaft having inner and outer ends is rotatably mounted in the second pipe piece, the inner end of the second shaft supporting a second adjusting member, the other end of the second shaft being connected to a manually operated second hand lever, the second hand lever extending essentially parallel to the support member, a second rod-like tension or compression member being connected to the second adjusting member, the other end of the second tension or compression member facing away from the adjusting member being articulated to a pivotable second angular lever, one arm of the second angular lever acting on a valve tappet of a second gas pressure spring vertically mounted in the support tube.

6. The chair according to claim 5, wherein both tension or compression members extend in or near the vertical middle plane of the support member.

7. The chair according to claim 5, wherein the pipe pieces have inner ends, the inner ends being spaced apart and defining a space therebetween, the two adjusting members being located in the space, the points of attachment of the tension or compression members being located above a horizontal plane extending through the pivoting axis of the mounting plate when the hand levers are not operated.

8. The chair according to claim 5, wherein the tension or compression members are bent over the length thereof.

9. The chair according to claim 3, wherein the support member is an upwardly open shell having essentially the shape of an equilateral triangle with upwardly bent rims, the support member connected to the support tube extending obliquely upwardly therefrom, the support member having a portion of reduced thickness, the portion of reduced thickness being attached to the support tube.

10. The chair according to claim 9, wherein the pipe pieces extend through the rim of the shell-shaped support member, the portions of the pipe pieces located inwardly of the rim being connected to the support member by means of clamping members.

11. The chair according to claim 2, wherein the two-armed lever acting on the valve tappet is an angular lever, the pivoting axis of the angular lever being located between the shaft journals of the block member of the gas pressure spring and the pivoting axis of the mounting plate, the pivoting axis of the angular lever being located below a plane extending through the shaft journals and the pivoting axis of the mounting plate.

12. The chair according to claim 2 comprising a mechanical helical pressure spring extending parallel to the gas pressure spring, the gas pressure spring extending coaxially within the helical pressure spring, the helical pressure spring having a lower end, the lower end resting against the bearing block supporting the gas pressure spring.

13. The chair according to claim 12, wherein an essentially U-shaped yoke is attached to the end of the gas pressure spring facing the mounting plate, the U-shape yoke having downwardly directed sides, the sides being pivotally connected to the mounting plate, the upper end of the helical pressure spring extending through the gas pressure spring being supported on a lower side of a web defined by the U-shaped yoke.

14. The chair according to claim 12, wherein the lower end of the helical pressure springs rests on a fork-shaped lever arm of another two-armed lever, the other lever arm of the another two-armed lever being pivotable by means of a threaded spindle, the another two-armed lever being pivotable about an axis which is located between the shaft journals and the axis of the pipe pieces and extends parallel to the axis of the pipe pieces.

15. The chair according to claim 1, wherein the gas pressure spring supporting the mounting plate includes a downwardly directed acute angle with the vertical axis of the support tube, the gas pressure spring being connected to the mounting plate in or near the point where the vertical axis of the support tube intersects the mounting plate.

16. The chair according to claim 1, wherein two rod-like pressure or tension members are arranged on the first arm of the two-armed lever, the ends of the tension or compression members being attached on points of the adjusting member located diametrically with respect to the pivoting axis, the adjusting member having at the edge thereof a notch, the notch being engageable by a stationary locking member.

* * * * *